US005842085A

United States Patent [19]

Mitsuya

[11] Patent Number: 5,842,085

[45] Date of Patent: Nov. 24, 1998

[54] FIXING DEVICE IN AN IMAGE FORMING MACHINE HAVING REDUCED THERMAL FATIGUE

[75] Inventor: Toshiyuki Mitsuya, Osaka, Japan

[73] Assignee: Mita Industrial Co., Ltd., Osaka, Japan

[21] Appl. No.: 890,449

[22] Filed: Jul. 9, 1997

[30] Foreign Application Priority Data

Jul. 9, 1996 [JP] Japan ..... 8-199654

[51] Int. Cl.[6] ..... G03G 15/20

[52] U.S. Cl. ..... 399/122; 399/320

[58] Field of Search ..... 399/122, 320, 399/97; 711/399, 711, 546, 383, 727; 219/533

[56] References Cited

U.S. PATENT DOCUMENTS 3,396,996 8/1968 Raptis ..... 411/399

4,577,402 3/1986 Swanstrom ..... 411/424 X

*Primary Examiner*—Arthur T. Grimley

*Assistant Examiner*—Quana Grainger

*Attorney, Agent, or Firm*—Antonelli, Terry, Stout & Kraus, LLP

[57] ABSTRACT

A synthetic resin cover having a grip is mounted on the upper surface of an upper case board that constitutes part of the fixing housing and covers the upper side of the fixing roller of an image forming machine. The cover has a cover body and attaching portions, the lower surfaces of the attaching portions being higher than the lower surface of the cover body. The attaching portion includes a cylindrical portion having a fastening member insertion hole and a receiving portion provided at the lower end of the cylindrical portion and having an insertion hole. The fastening member has a head portion of a diameter larger than that of the insertion hole formed in the receiving portion, a columnar portion connected to the head portion and having a diameter smaller than that of the insertion hole but is larger than that of a threaded hole formed in the upper case board, and a threaded portion that is connected to the columnar portion and that can be screwed into the threaded hole formed in the upper case board. The length of the columnar portion is greater than the thickness of the receiving portion and is related to the distance of from the upper surface of the receiving portion to the lower surface of the cover body.

6 Claims, 10 Drawing Sheets

FIXING DEVICE IN AN IMAGE FORMING MACHINE HAVING REDUCED THERMAL FATIGUE

FIELD OF THE INVENTION

The present invention relates to a fixing device for heat-fixing toner images transferred onto a paper, the fixing device being mounted on an image-forming machine such as electrostatic copying machine, facsimile, laser printer, etc.

DESCRIPTION OF THE PRIOR ART

Image-forming machines are equipped with a fixing device for heat-fixing toner images transferred onto a suitable paper. The fixing device of this kind is provided with a pair of fixing rollers consisting of a heating roller and a pressing roller. The heating roller is constituted by placing a heater in a roller body made of an aluminum alloy coated on its outer peripheral surfaces with a fluorine-containing resin or the like. The pressing roller is constituted by fitting a cylindrical roller portion composed of a silicone rubber or the like onto a roller body made of an aluminum alloy. The thus constituted heating roller and pressing roller are consumables, subject to wearing out, and are, hence, replaced by new ones after they are used for predetermined periods of time. For this purpose, the fixing device is constructed as a unitary structure and is detachably mounted on a predetermined portion of the image-forming machine.

The fixing machine constructed as a unitary structure has a grip for being carried by hand after it is removed from the body of the image-forming machine. The grip is attached to a synthetic resin cover fastened by screws onto the upper surface of an upper metallic case board covering the upper side of the fixing roller.

FIGS. 9 and 10 illustrate a structure for attaching a synthetic resin cover onto the upper metallic case board that covers the upper side of the fixing roller in a conventional fixing device. A cover 100 made of a synthetic resin comprises a cover body 110 having two attaching portions 120, 120, spaced at a predetermined distance in the lengthwise direction of the cover body 110. The cover body 110 is provided with an elongated recessed portion 111, and has grip insertion holes 112, 112 at portions adjacent to the attaching portions 120, 120. Such attaching portion 120 comprises a cylindrical portion 122 having a hole 121 with a receiving portion 124 formed at the lower end of the cylindrical portion 122 and having an insertion hole 123 through the receiving portion. In the thus constituted synthetic resin cover 100, a belt-like flexible grip 130 having elongated holes 131, 131 at both ends thereof is disposed in the recessed portion 111 of the cover body 110. The ends of the grip 130 are inserted in the grip insertion holes 112, 112, and the elongated holes 131, 131 formed at both ends are fitted to the cylindrical portions 122, 122 of the attaching portions 120, 120. With the grip 130 being fitted to the synthetic resin cover 100, screws 140, 140, having a head portion 141 and a threaded portion 142 are inserted in the screw insertion holes 121. The 121, the threaded portions 142, 142, of the screws 140, 140 are inserted in the insertion holes 123, 123 and are screwed into threaded holes 151, 151 formed in the upper metallic case board 150 of cover body 110 so that the receiving portions 124, 124 of the attaching portions 120, 120 are fastened to the upper surface of the upper case board 150.

In the heretofore employed structure for attaching the cover, the receiving portions 124, 124 of the attaching portions 120, 120 are fixed by screws to the upper case board 150. Every time the fixing device is lifted up by holding the grip 130, therefore, load is exerted on the receiving portions 124, 124, and stress is generated. Besides, since the receiving portions 124, 124 are in contact with the upper metallic case board 150, heat in the fixing device is conducted to the receiving portions 124, 124 through the upper metallic case board 150 and consequently, gives rise to the occurrence of cracking at an early time due to thermal fatigue and stress.

SUMMARY OF THE INVENTION

The object of the present invention is to provide a fixing device for an image-forming machine having a mounting structure which prevents the synthetic resin cover, mounted on the upper case board to cover the upper side of the fixing roller, from being cracked due to thermal fatigue.

In order to accomplish the above-mentioned object according to the present invention, there is provided a fixing device for an image-forming machine having a synthetic resin cover, with a grip mounted on the upper surface of an upper case board that constitutes part of the fixing housing and covers the upper side of the fixing roller, said cover having a cover body and attaching portions formed together with the cover body as a unitary structure and being fixed on said upper case board by fastening members inserted in said attaching portions; wherein each said attaching portion includes a cylindrical portion having a fastening member hole and a receiving portion provided at the lower end of said cylindrical portion and having an insertion hole, the lower surface of said receiving portion having a position higher than the lower surface of said cover body; and said fastening member has a head portion of a diameter larger than that of said insertion hole formed in said receiving portion, a columnar portion connected to said head portion and having a diameter smaller than that of said insertion hole but larger than that of a threaded hole formed in said upper case board, and a threaded portion that is connected to said columnar portion and can be screwed into the threaded hole formed in said upper case board, the length of said columnar portion being greater than the thickness of the receiving portion and corresponding to the distance from the upper surface of said receiving portion to the lower surface of said cover body.

According to the present invention, there is further provided a fixing device for an image-forming machine having a synthetic resin cover with a grip mounted on the upper surface of an upper case board that constitutes part of the fixing housing and covers the upper side of the fixing roller, said cover having a cover body and attaching portions formed together with the cover body as a unitary structure and being fixed on said upper case board by fastening members inserted in said attaching portions; wherein each said attaching portion includes a large-diameter cylindrical portion having a fastening member hole, a receiving portion provided at the lower end of said large-diameter cylindrical portion and having an insertion hole of a diameter smaller than that of said fastening member hole, and a small-diameter cylindrical portion protruding from the lower surface of said receiving portion and having an insertion hole of a diameter smaller than that of said fastening member hole, the surface at the lower end of said small-diameter cylindrical portion having a position higher than the lower surface of said cover body; and said fastening member has a head portion of a diameter larger than that of said insertion hole in said receiving portion, a columnar portion connected to said head portion and having a diameter smaller than that of the insertion hole formed in said receiving portion but larger than that of a threaded hole formed in said upper case board, and a threaded portion that is connected to said columnar portion and can be screwed into the threaded hole formed in said upper case board, the length of said columnar portion being greater than the distance from the upper surface of said receiving portion to the surface at the lower end of said small-diameter cylindrical portion and corresponding to the distance from the upper surface of said receiving portion to the lower surface of said cover body.

Other features of the present invention will become obvious from the following description.

DETAILED DESCRIPTION OF THE PREFERRED EMBODIMENTS

Preferred embodiments of a fixing device in an image-forming machine constituted according to the present invention will now be described in detail, with reference to the accompanying drawings.

Figure 1:
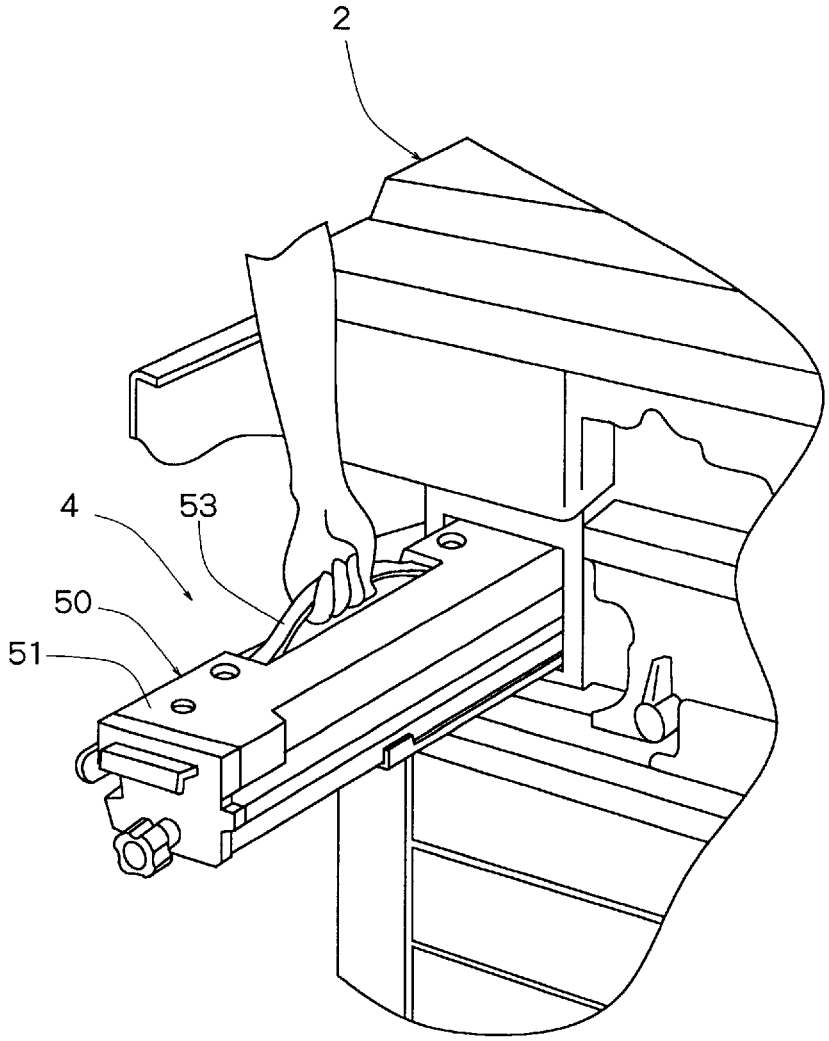
FIG. 1 is a perspective view of an embodiment of a fixing device constituted according to the present invention, illustrating a state where the device is pulled out from an image-forming machine.
Figure 2:
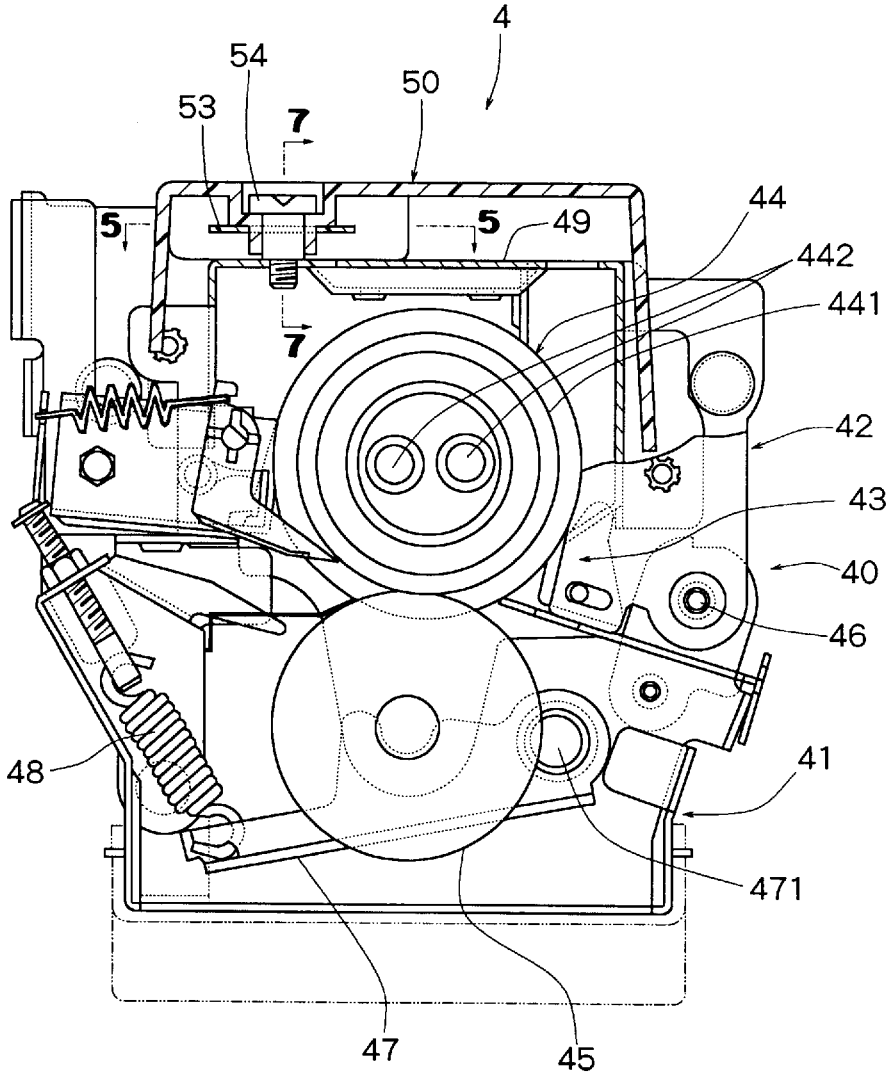
FIG. 2 is a sectional view of the fixing device shown in FIG. 1.

FIG. 1 illustrates a fixing device 4 constituted according to the present invention as the device is pulled out from a predetermined position of an image-forming machine body 2, and FIG. 2 is a sectional view of the fixing device 4 constituted according to the present invention.

The fixing device 4 is equipped with a fixing housing member 40 constituted by a lower housing 41 and an upper housing member 42. The upper housing member 42 is pivotally supported by the lower housing member 41 by means of a pivot shaft 46. In the thus constituted fixing housing 40 are arranged a pair of fixing rollers 43, including by a heating roller 44 mounted on the upper housing member 42 and a pressing roller 45 mounted on the lower housing member 41. The heating roller 44 is constituted by a roller body 441 made of an aluminum alloy coated on its outer peripheral surfaces with a fluorine-containing resin or the like and heaters 442 arranged inside the roller body 441. The pressing roller 45 is constituted by fitting a cylindrical elastic roller portion made of a silicone rubber or the like onto a roller body made of an aluminum alloy. The pressing roller 45 is rotatably mounted on a roller support member 47 that is pivotally supported at its one end to the lower housing member 41 by a support shaft 471. The pressing roller 45 is brought into contact with the heating roller 44 by a coil spring 48 that extends between the other end of the roller support member 47 and the lower housing member 41.

A cover 50 made of a synthetic resin is mounted on the upper surface of an upper case board 49 that is made of a metallic member to constitute part of the upper housing member 42 and to cover the upper side of the heating roller 44 of the fixing rollers 43.

Figure 3:
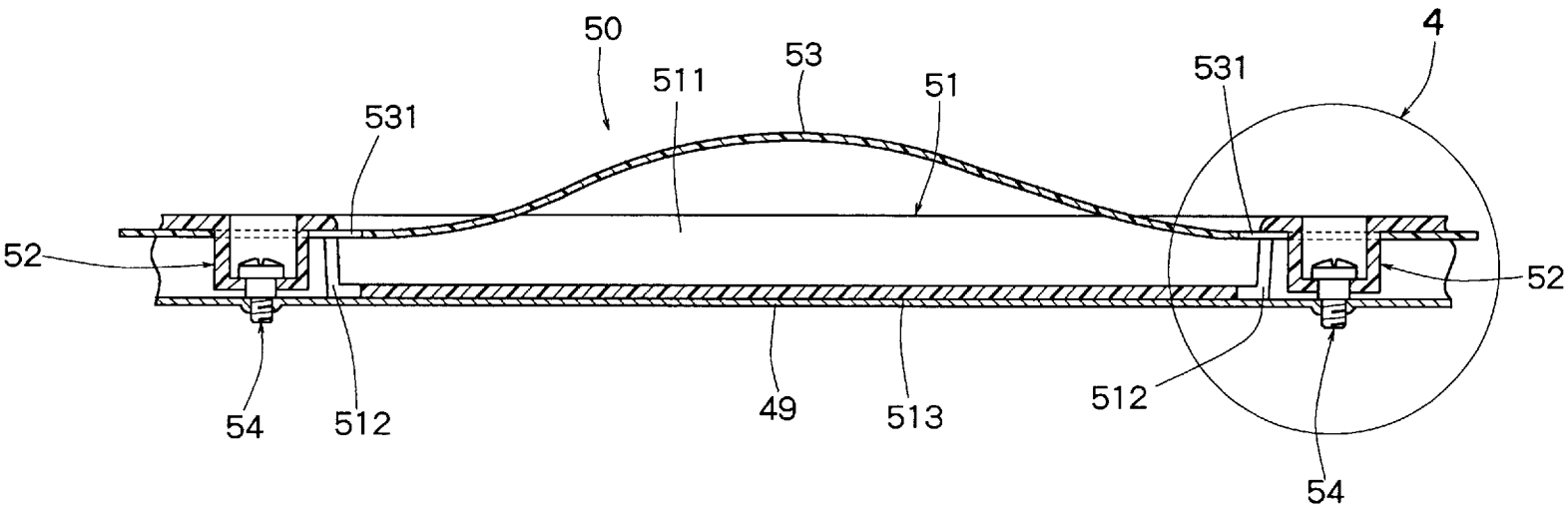
FIG. 3 is a sectional view of am embodiment of a fixing device constituted according to the present invention.
Figure 4:
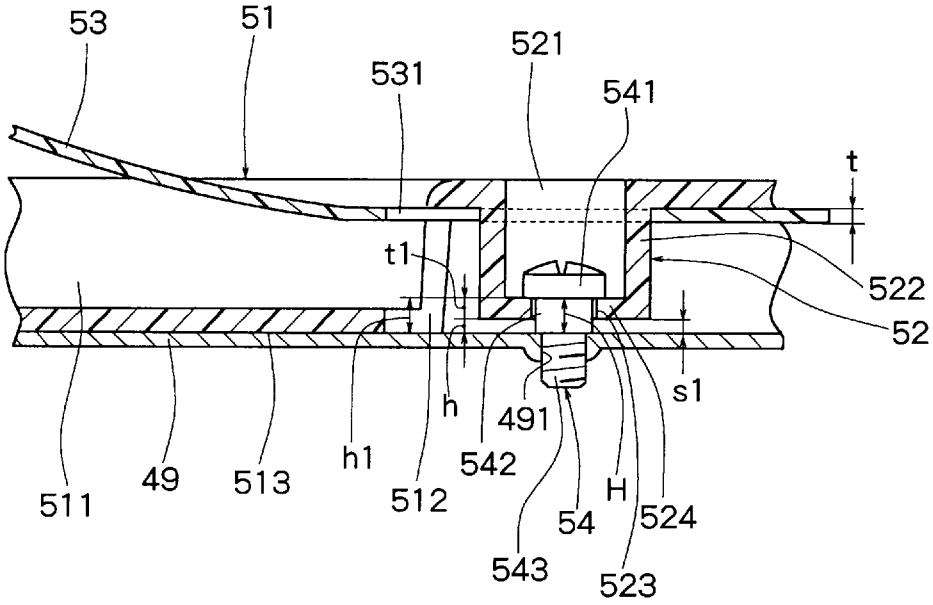
FIG. 4 is a view illustrating a portion 3 of FIG. 3 on an enlarged scale.

Described below is an embodiment of a structure for mounting the cover 50 on the upper case board 49 by making reference also to FIGS. 3 and 4.

The cover 50 comprises a cover body 51 having two attaching portions 52, 52, spaced at a predetermined distance in the lengthwise direction, which are molded as a unitary structure using a suitable synthetic resin. The cover body 51 is provided with an elongated recessed portion 511 formed between the two attaching portions 52, 52. Grip insertion holes 512, 512 are formed in the portions of the walls forming the recessed portion 511 that are adjacent the attaching portions 52, 52.

Each attaching portion 52 comprises a cylindrical portion 522, having a fastening member hole 521, and a receiving portion 524 formed at the lower end of the cylindrical portion 522 and having an insertion hole 523. The lower surface of the receiving portion 524 is higher than the lower surface 513 of the cover body 51. In the illustrated embodiment, the length (h) from the lower surface of the receiving portion 524 to the lower surface 513 of the cover body 51 is set to be less than the thickness (t) of a grip 53 that is made of a flexible synthetic resin and is arranged in the recessed portion 511 of the cover body 51. The grip 53 has elongated holes 531, 531 formed at the two ends thereof. The ends are inserted through the grip insertion holes 512, 512, and the elongated holes 531, 531 formed in the end portions are fitted to the cylindrical portions 522, 522 of the attaching portions 52, 52.

The cover 50 equipped with the grip 53 is attached to the upper case board 49 by fastening members 54, 54. Each fastening member 54 has a head portion 541 of a diameter smaller than that of the fastening member holes 521 but larger than that of the insertion hole 523 formed in the receiving portion 524, a columnar portion connected to the head portion 541 and having a diameter smaller than that of the insertion hole 523 formed in the receiving portion 524 but larger than that of a threaded hole 491 formed in the upper case board 49, and a threaded portion 543 that is connected to the columnar portion 542 and can be screwed into the threaded hole 491 formed in the upper case board 49. The length (H) of the columnar portion 542 of the fastening member 54 is greater than the thickness (t1) of the receiving portion 524, and is related to the distance (h1) from the upper surface of the receiving portion 524 to the lower surface 513 of the cover body 51. Strictly speaking, the length (H) of the columnar portion 542 is greater than the thickness (t1) of the receiving portion 524, and is equal to, or slightly less than, the distance (h1) from the upper surface of the receiving portion 524 to the lower surface 513 of the cover body 51 ($t1<H\leqq h1$). Furthermore, the length (H) of the columnar portion 542 is greater than the thickness (t1) of the receiving portion 524 but is smaller than the sum of the thickness (t1) of the receiving portion 524 and the thickness (t) of the grip 53 ($t1<H<(t1+t)$).

The thus constituted fastening member 54 is inserted in the fastening member hole 521 formed in the attaching portion 52 from the upper side, the threaded portion 543 and the columnar portion 542 are inserted in the insertion hole 523 formed in the receiving portion 524, and the threaded portion 543 is screwed into the threaded hole 491 formed in the upper case board 49, so that the cover 50 is fastened to the upper surface of the upper case board 49. In a state where the cover 50 is fastened to the upper surface of the upper case board 49, the lower surface 513 of the cover body 51 comes into contact with the upper surface of the upper case board 49 and is depressed, whereby a gap (S1) is formed between the lower surface of the receiving portion 524, which is the lower end of the attaching portion 52 and the upper surface of the upper case board 49, the gap (S1) being smaller than the thickness (t) of the grip 53 which corresponds to the distance (h) from the lower surface of the receiving portion 524 to the lower surface 513 of the cover body 51.

In the illustrated embodiment, the lower end of the attaching portion 52 of the cover 50 does not come into contact with the upper case board 49, and the gap (S1) is formed relative to the upper surface of the upper case board 49. Therefore, heat in the fixing device 4 is not directly conducted to the receiving portion 524 via the upper case board 49. Accordingly, the receiving portion 524 of the attaching portion 52 of the cover 50 is not thermally worn out at an early time. Even when a load is exerted as a result of using the grip 53, therefore, the receiving portion does not crack due to thermal fatigue. Moreover, since the gap (S1) between the lower surface of the attaching portion 52 and the upper surface of the upper case board 49 is smaller than the thickness (t) of the grip 53, the grip 53 fitted to the cylindrical portions 522, 522 of the attaching portions 52, 52 does not bite into the gap.

Figure 5:
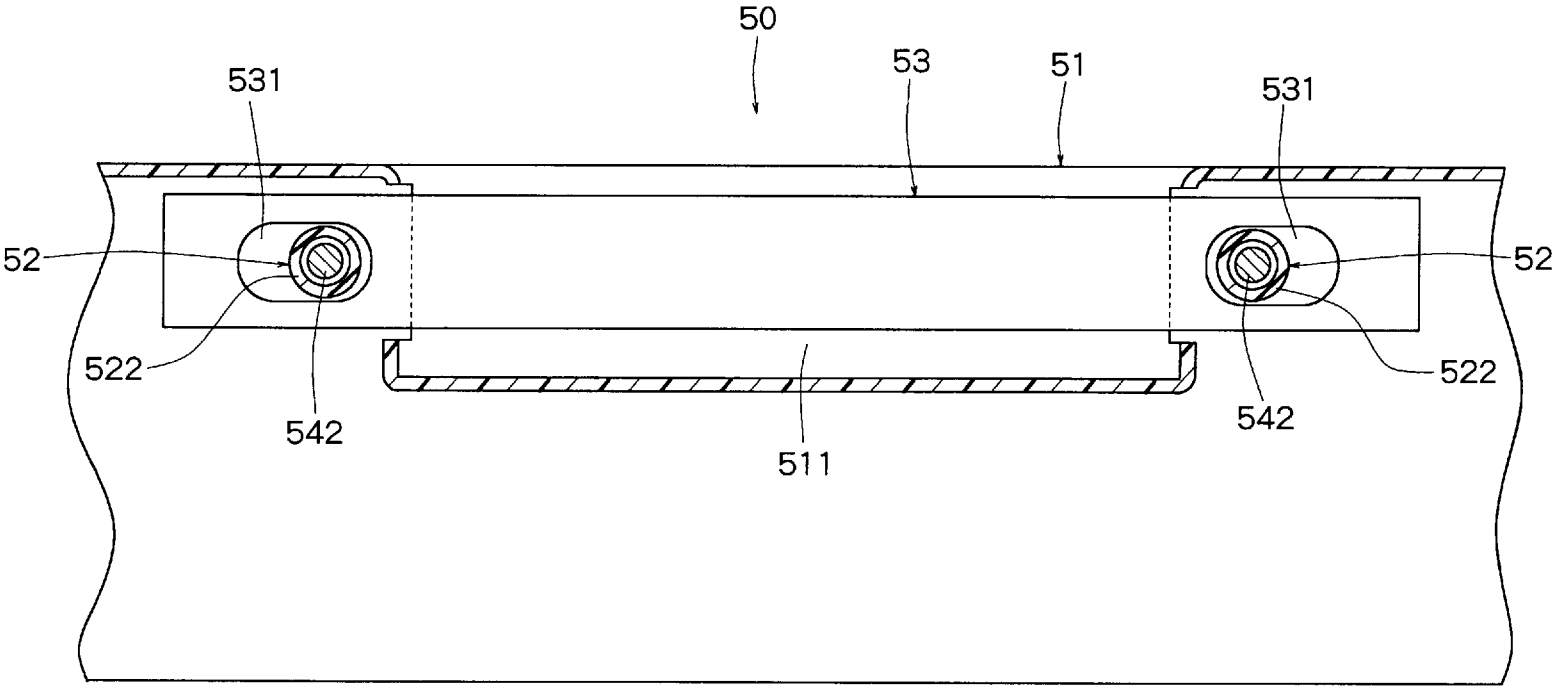
FIG. 5 is a sectional view along the line 5—5 in FIG. 2.
Figure 6:
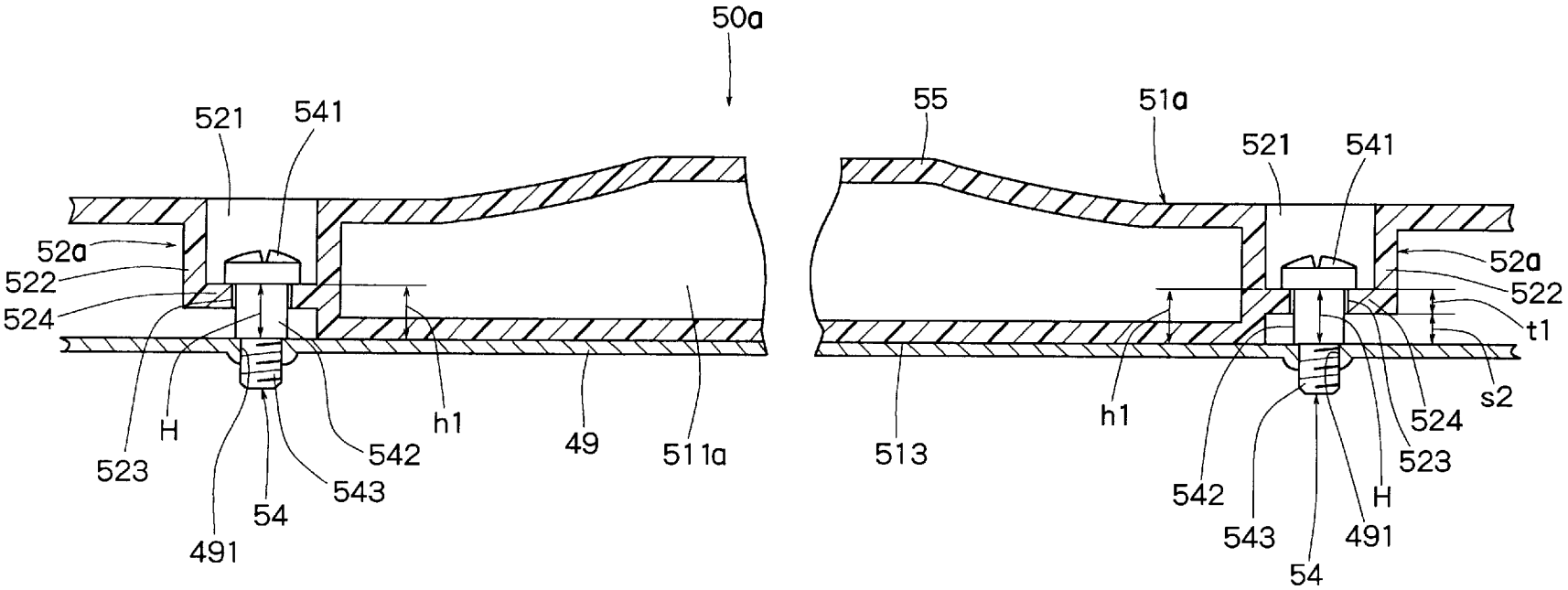
FIG. 6 is a sectional view of another embodiment of a fixing device constituted according to the present invention.

Next, described below with reference to FIG. 6 is another embodiment of the fixing device constituted according to the present invention. In the embodiment of FIG. 6, members corresponding members of the embodiment of FIGS. 1 to 5 are denoted by corresponding reference numerals.

In the embodiment shown in FIG. 6, the cover 50*a* includes a cover body 51*a*, two attaching portions 52*a*, 52*a* provided in the cover body 51*a*, spaced at a predetermined distance, in the lengthwise direction thereof, and a grip 55 provided between the two attaching portions 52*a*, 52*a*, all of which are molded as a unitary structure using a suitable synthetic resin. The cover body 51*a* is provided with an elongated recessed portion 511*a* formed between the two attaching portions 52*a* and 52*a*.

Like that of the embodiment shown in FIGS. 1 to 5, the attaching portion 52*a* comprises a cylindrical portion 522, having a fastening member hole 521, and a receiving portion 524, provided at the lower end of the cylindrical portion 522 and having an insertion hole 523 of a diameter smaller than that of the fastening member hole 521, the lower surface of the receiving portion 524 being higher than the lower surface 513 of the cover body 51*a*.

Like that of the embodiment shown in FIGS. 1 to 5, the fastening member 54 for fastening the cover 50 to the upper case board 49 comprises a head portion 541 of a diameter smaller than that of the fastening member hole 521 formed in the attaching portion 52 but larger than that of the insertion hole 523 formed in the receiving portion 524, a columnar portion 542 connected to the head portion 541 and having a diameter smaller than that of the insertion hole 523 formed in the receiving portion 524 but larger than that of the threaded hole 491 formed in the upper case board 49, and a threaded portion 543 that is connected to the columnar portion 542 and is screwed into the threaded hole 491 formed in the upper case board 49. The length (H) of the columnar portion 542 constituting the fastening member 54 is greater than the thickness (t1) of the receiving portion 524, and is related to the length (h1) from the upper surface of the receiving portion 524 to the lower surface 513 of the cover body 51. Strictly speaking, the length (H) of the columnar portion 542 is greater than the thickness (t1) of the receiving portion 524, and is equal to, or slightly less than, the distance (h1) from the upper surface of the receiving portion 524 to the lower surface 513 of the cover body 51 ($t1<H\leqq h1$).

The grip 55 is provided over the recessed portion 511*a* between the two attaching portions 52*a* and 52*a*, and is molded together with the cover body 51*a* as a unitary structure.

In the thus constituted embodiment shown in FIG. 6, like in the embodiment shown in FIGS. 1 to 5, when the cover 50*a* is mounted on the upper surface of the upper case board 49 by the fastening members 54, 54, the lower surface 513 of the cover body 51*a* is brought into contact with the upper surface of the upper case board 49 and is depressed, and a predetermined gap (S2) is formed between the lower surface of the receiving portion 524*a* which is the lower end of the attaching portion 52*a* and the upper surface of the upper case board 49. Therefore, heat in the fixing device 4 is not directly conducted to the receiving portion 524 via the upper case board 49.

Figure 7:
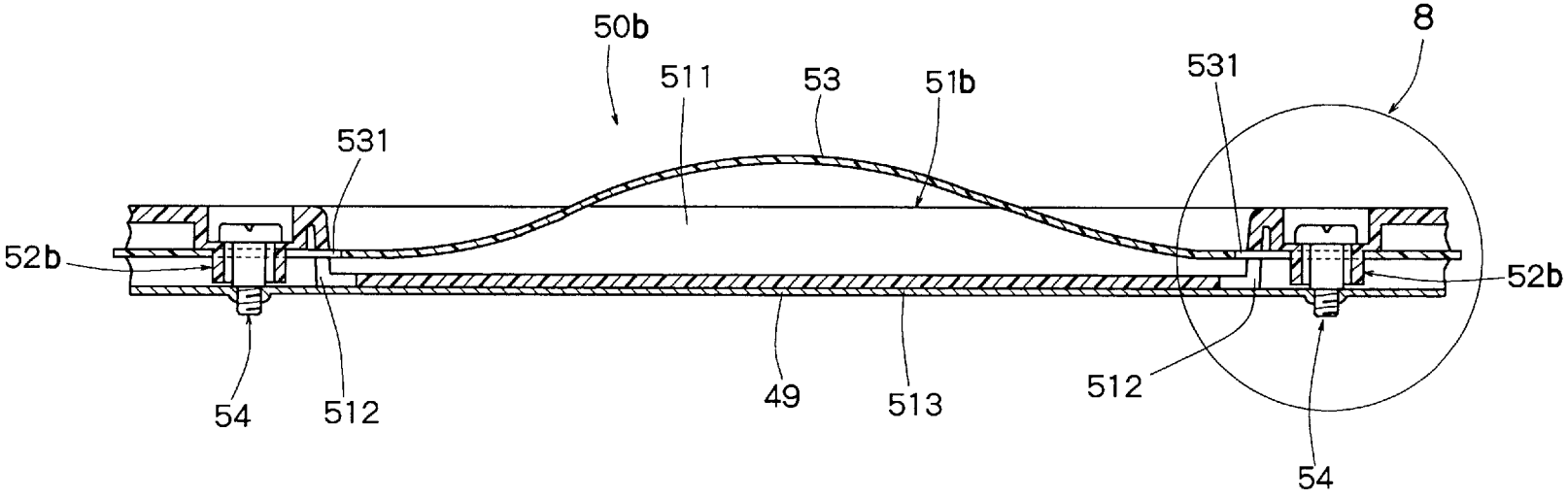
FIG. 7 is a sectional view of a further embodiment of a fixing device constituted according to the present invention and is taken along line 7—7 in FIG. 2.
Figure 8:
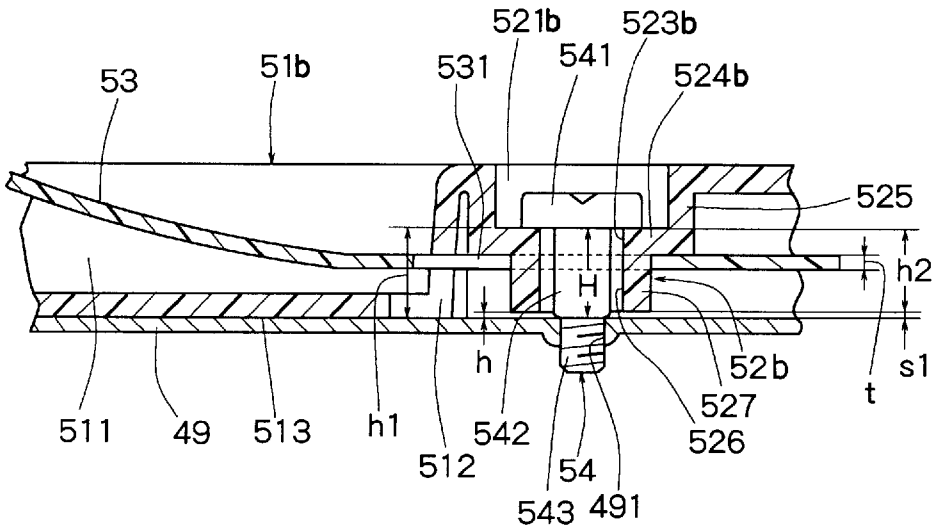
FIG. 8 is a view illustrating a portion 8 of FIG. 7 on an enlarged scale.
Figure 9:
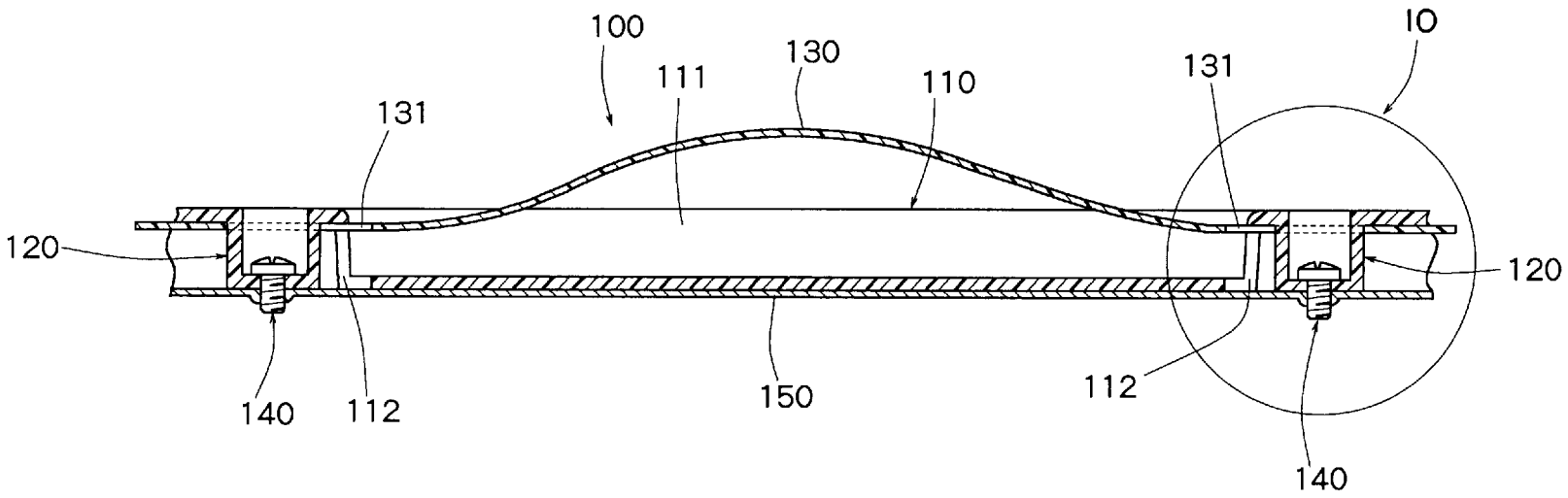
Fig. 9 (PRIOR ART)
FIG. 9 is a sectional view of a conventional fixing device.
Figure 10:
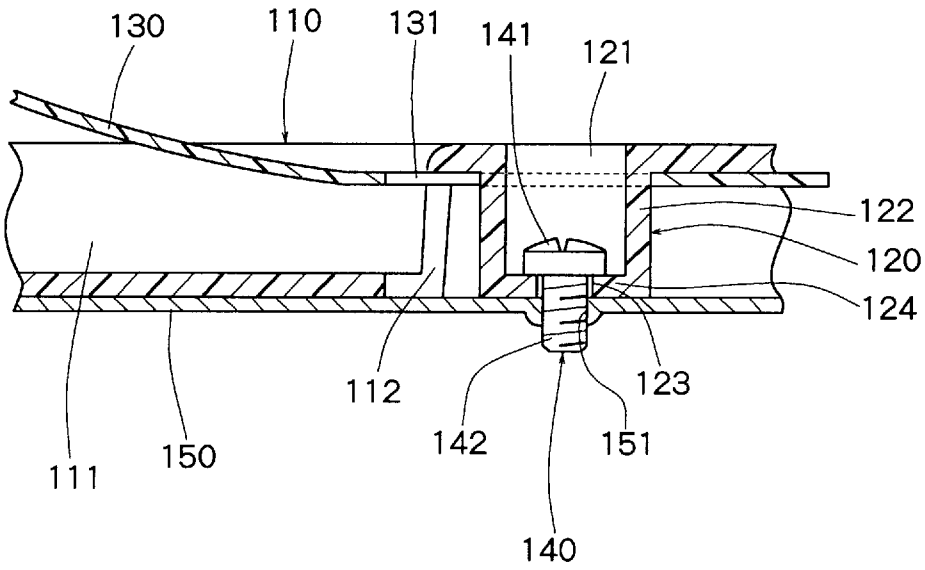
Fig. 10 (PRIOR ART)
FIG. 10 is a view illustrating a portion 10 of FIG. 9 on an enlarged scale.

Described below with reference to FIGS. 5, 7 and 8 is a further embodiment of the fixing device constituted according to the present invention. In the embodiment shown in FIGS. 7 and 8, members corresponding to members of the embodiment of FIGS. 1 to 5 are denoted by corresponding reference numerals.

In the embodiment shown in FIGS. 7 and 8, the cover 50*b* comprises the cover body 51*b* and two attaching portions 52*b*, 52*b* spaced at a predetermined distance in the lengthwise direction on the cover body 51*b*. Like in the embodiment shown in FIGS. 1 to 5, the cover body 51*b* is provided with an elongated recessed portion 511 formed between the two recessed portions 52*b* and 52*b*, and grip insertion holes 512 and 512 are formed in the portions of the walls forming the recessed portion 511 that are adjacent the attaching portions 52*b*, 52*b*.

Each attaching portion 52*b* comprises a large-diameter cylindrical portion 525 having a fastening member hole 521*b*, a receiving portion 524*b* formed at the lower end of the large-diameter cylindrical portion 525 and having a first insertion hole 523*b* therethrough of a diameter less than that of the fastening member hole 521*b*, and a small-diameter cylindrical portion 527 extending from the lower surface of the receiving portion 524*b* and defining a second insertion hole 526 of a diameter the same as that of the first insertion hole 523*b*. The lower end surface of the small-diameter cylindrical portion 527 has a position higher than the lower surface 513 of the cover body 51*b*. In the illustrated embodiment, the distance (h) of from the lower end surface of the small-diameter cylindrical portion 527 to the lower surface 513 of the cover body 51*b* is less than the thickness (t) of the grip 53.

Like in the embodiment shown in FIGS. 1 to 5, the thus constituted synthetic resin cover 50*b* has a grip 53 made of a flexible synthetic resin arranged in the recessed portion 511 of the cover body 51*b*, both ends thereof being inserted through the grip insertion holes 512, 512, and the elongated holes 531, 531 formed at both ends of the grip 53 are fitted to the small-diameter cylindrical portions 527, 527 of the attaching portions 52*b*, 52*b*.

Like in the embodiment shown in FIGS. 1 to 5, the fastening member 54 for fastening the cover 50*b* to the upper case board 49 includes a head portion 541 of a diameter less than that of the fastening member hole 521*b* formed in the attaching portion 52*b* but larger than that of the insertion hole 523*b* formed in the receiving portion 524*b*, a columnar portion 542 connected to the head portion 541 and having a diameter less than that of the first insertion hole 523*b* formed in the receiving portion 524*b* but larger than that of the threaded hole 491 formed in the upper case board 49, and a threaded portion 543 that is connected to the columnar portion 542 and that can be screwed into the threaded hole 491 formed in the upper case board 49. The length (H) of the columnar portion 542 of the fastening member 54 is greater than the distance (h2) from the upper surface of the receiving portion 524*b* to the lower end surface of the small-diameter cylindrical portion 527 and is related to the length (h1) from the upper surface of the receiving portion 524*b* to the lower surface 513 of the cover body 51*b*. Strictly speaking, the length (H) of the columnar portion 542 is greater than the distance (h2) from the upper surface of the receiving portion 524*b* to the lower end surface of the small-diameter portion 527, and is equal to, or slightly less than, the distance (h1) from the upper surface of the receiving portion 524*b* to the lower surface 513 of the cover body 51*b* ($h2<H\leqq h1$). Furthermore, the length (H) of the columnar portion 542 is greater than the distance (h2) from the upper surface of the receiving portion 524*b* to the lower end surface of the small-diameter portion 527 but is less than the sum of the distance (h2) from the upper surface of the receiving portion 524*b* to the lower end surface of the small-diameter portion 527 and the thickness (t) of the grip 53 ($h2<H<(h2+t)$).

In the thus constituted embodiment shown in FIGS. 7 and 8 like in the embodiment shown in FIGS. 1 to 5, when the cover 50*b* is attached to the upper surface of the upper case board 49 by the fastening members 54, 54, the bottom surface 513 of the cover body 51*b* is brought into contact with the upper surface of the upper case board 49 and is depressed, and a gap (S1) is formed between the lower end surface of the small-diameter cylindrical portion 527 that is the lower end of the attaching portion 52*b* and the upper surface of the upper case board 49, the gap (S1) being smaller than the thickness (t) of the grip 53 that corresponds to the length (h) of from the lower surface of the receiving portion 524*b* to the lower surface 513 of the cover body 51*b*. Therefore, heat in the fixing device 4 is not directly conducted to the receiving portion 524*b* through the upper case board 49. Moreover, since the gap (S1) formed between the lower end surface of the attaching portion 52*b* and the upper surface of the upper case board 49 is smaller than the thickness (t) of the grip 53, the grip 53 fitted to the small-diameter cylindrical portions 527, 527 of the attaching portions 52*b*, 52*b* does not bite into the gap. In the embodiment shown in FIGS. 7 and 8, the elongated holes 531, 531 formed at both ends of the grip 53 are fitted to the small-diameter cylindrical portions 527, 527 of the attaching portions 52*b*, 52*b*. Therefore, the elongated holes 531, 531 are allowed to have a minor diameter smaller than that of the embodiment of FIGS. 1 to 5, making it possible to decrease the width of the grip 53.

What we claim is:

1. A fixing device for an image-forming machine comprising a fixing housing having a fixing roller therein; and a synthetic resin cover having a grip member and mounted on an upper surface of an upper case board of the fixing housing to cover an upper side of the fixing roller, said cover including a cover body and attaching portions formed together with the cover body as a unitary structure and being mounted on said upper case board by fastening members arranged in said attaching portions; wherein each said attaching portion includes a cylindrical portion having a fastening member hole thereinto, and a receiving portion at a lower end of said cylindrical portion with an insertion hole therethrough, the lowest surface of said receiving portion having a position higher than the lowest surface of said cover body; and said fastening member comprising a head portion of a diameter larger than the diameter of said insertion hole, a columnar portion connected to said head portion and having a diameter smaller than the diameter of said insertion hole but larger than the diameter of a threaded hole formed in said upper case board, and a threaded portion that is connected to said columnar portion and screwed into the threaded hole formed in said upper case board, the length of said columnar portion being greater than the thickness of the receiving portion and less than the distance from the upper surface of said receiving portion to the lower surface of said cover body, so that when the cover is fastened to the upper surface of the upper case board, the lower surface of the cover body contacts the upper surface of the upper case board, and a gap is provided between the lower surface of the attaching portion and the upper surface of the upper case board.

2. A fixing device for an image-forming machine according to claim 1, wherein said grip member is a flexible belt-like member having elongated holes formed therein and fitted to said cylindrical portions.

3. A fixing device for an image-forming machine according to claim 2, wherein the distance from the lower surface of said receiving portion to the lower surface of said cover body is less than the thickness of said grip member.

4. A fixing device for an image-forming machine comprising a fixing housing having a fixing roller therein; and a synthetic resin cover having a grip member and mounted on an upper surface of an upper case board of the fixing housing to cover an upper side of the fixing roller, said cover including a cover body and attaching portions formed together with the cover body as a unitary structure and being mounted on said upper case board by fastening members arranged in said attaching portions; wherein each said attaching portion includes a large-diameter cylindrical portion having a fastening member hole thereinto, a receiving portion at a lower end of said large-diameter cylindrical portion with a first insertion hole therethrough of a diameter less than the diameter of said fastening member hole, and a small-diameter cylindrical portion extending from a lower surface of said receiving portion and having a second insertion hole therethrough of a diameter less than the diameter of said fastening member hole, the surface at the lowest end of said small-diameter cylindrical portion having a position higher than the lowest surface of said cover body; and said fastening member comprises a head portion of a diameter larger than the diameter of said first insertion hole, a columnar portion connected to said head portion and having a diameter less that the diameter of the first insertion hole but larger than the diameter of a threaded hole formed in said upper case board, and a threaded portion that is connected to said columnar portion and screwed into the threaded hole formed in said upper case board, the length of said columnar portion being greater than the distance from the upper surface of said receiving portion to the surface at the lower end of said small-diameter cylindrical portion and less than the distance from the upper surface of said receiving portion to the lower surface of said cover body, so that when the cover is fastened to the upper surface of the upper case board, the lower surface of the cover body contacts the upper surface of the upper case board, and a gap is provided between the lower surface of the attaching portion and the upper surface of the upper case board.

5. A fixing device for an image-forming machine according to claim 4, wherein said grip member is a flexible belt-like member having elongated holes formed therein and fitted to said small-diameter cylindrical portions.

6. A fixing device for an image-forming machine according to claim 5, wherein the distance from the lower surface of said small-diameter cylindrical portion to the lower surface of said cover body is less than the thickness of said grip member.

* * * * *